US011456541B2

(12) United States Patent
Hao et al.

(10) Patent No.: US 11,456,541 B2
(45) Date of Patent: Sep. 27, 2022

(54) LOW-LOSS FEEDING NETWORK AND HIGH-EFFICIENCY ANTENNA DEVICE

(71) Applicant: SOUTHEAST UNIVERSITY, Jiangsu (CN)

(72) Inventors: Zhangcheng Hao, Jiangsu (CN); Yiwen Wu, Jiangsu (CN)

(73) Assignee: SOUTHEAST UNIVERSITY, Jiangsu (CN)

( * ) Notice: Subject to any disclaimer, the term of this patent is extended or adjusted under 35 U.S.C. 154(b) by 74 days.

(21) Appl. No.: 17/257,271

(22) PCT Filed: Feb. 15, 2020

(86) PCT No.: PCT/CN2020/075448
§ 371 (c)(1),
(2) Date: Dec. 30, 2020

(87) PCT Pub. No.: WO2021/068442
PCT Pub. Date: Apr. 15, 2021

(65) Prior Publication Data

US 2021/0367354 A1 Nov. 25, 2021

(30) Foreign Application Priority Data

Oct. 10, 2019 (CN) ..... 201910957016.4

(51) Int. Cl.
*H01Q 21/00* (2006.01)
*H01Q 13/10* (2006.01)
*H01Q 21/08* (2006.01)

(52) U.S. Cl.
CPC ..... *H01Q 21/0006* (2013.01); *H01Q 13/10* (2013.01); *H01Q 21/08* (2013.01)

(58) Field of Classification Search
CPC ..... H01Q 21/0006; H01Q 21/0031; H01Q 21/0037; H01Q 21/0043; H01Q 21/005; H01Q 13/10; H01Q 13/106
See application file for complete search history.

(56) References Cited

U.S. PATENT DOCUMENTS 6,317,094 B1 * 11/2001 Wu ..... H01Q 13/085 343/767
7,808,439 B2 * 10/2010 Yang ..... H01Q 13/22 343/771

(Continued)

FOREIGN PATENT DOCUMENTS

CN 104201465 12/2014
CN 109687107 4/2019

(Continued)

OTHER PUBLICATIONS

Jiang, "Investigations on millimeter-wave reflectarray and lens antennas," Doctor's thesis, Jun. 2015, School of Information Scienc and Engineering , Southeast University.

(Continued)

*Primary Examiner* — Jason Crawford
(74) *Attorney, Agent, or Firm* — JCIP Global Inc.

(57) ABSTRACT

A low-loss feeding network comprises a vertical switching structure, a substrate integrated waveguide (SIW), a $2^N$-way power divider, coupling slots, matching metal vias and parallel-plane waveguides, wherein the energy provided by a standard waveguide is coupled to the SIW through the vertical switching structure, and the energy outputted by the SIW is evenly split into $2^N$ parts by the $2^N$-way power divider; the energy of each way outputted by the $2^N$-way power divider is coupled to parallel-plane waveguides through the coupling slots and the matching metal vias, and the electric field at the junction of two adjacent parallel-plane waveguides is zero, so that an ideal virtual electric (Continued)

wall is formed, thus the structure of the feeding network is simplified, and the metal loss at the junction is reduced; finally, the energy provided by the low-loss feeding network is radiated in phase through the symmetrical slot antenna array.

12 Claims, 5 Drawing Sheets

(56) References Cited

U.S. PATENT DOCUMENTS

| | | | | |
|---|---|---|---|---|
| 2009/0066597 | A1* | 3/2009 | Yang | H01Q 13/22 343/771 |
| 2019/0081395 | A1* | 3/2019 | Daniel | H01Q 21/005 |
| 2019/0165480 | A1* | 5/2019 | Daniel | H01Q 13/106 |
| 2020/0028260 | A1* | 1/2020 | Achour | G01S 7/006 |
| 2020/0059007 | A1* | 2/2020 | Wang | H01Q 21/005 |
| 2021/0167518 | A1* | 6/2021 | Achour | H01Q 21/005 |
| 2021/0210858 | A1* | 7/2021 | Pelletti | H01Q 13/20 |
| 2021/0367354 | A1* | 11/2021 | Hao | H01Q 21/005 |

FOREIGN PATENT DOCUMENTS

| | | |
|---|---|---|
| CN | 109818158 | 5/2019 |
| CN | 110649388 | 1/2020 |

OTHER PUBLICATIONS

Yi-Wen Wu, "Extracting extremely wideband complex dielectric permittivity and effective conductivity by using one pair of SIW circular cavities." 2018 IEEE MTT-S International Wireless Symposium (IWS), May 6-10, 2018, pp. 1-3.

"International Search Report (Form PCT/ISA/210)" of PCT/CN2020/075448, dated Jun. 18, 2020, pp. 1-4.

* cited by examiner

LOW-LOSS FEEDING NETWORK AND HIGH-EFFICIENCY ANTENNA DEVICE

CROSS-REFERENCE TO RELATED APPLICATION

This application is a 371 of international application of PCT application serial no. PCT/CN2020/075448, filed on Feb. 15, 2020, which claims the priority benefits of China Patent Application No. 201910957016.4, filed on Oct. 10, 2019. The entirety of each of the above mentioned patent applications is hereby incorporated by reference herein and made a part of this specification.

TECHNICAL FIELD

The present invention relates to the technical field of communication, in particular to a low-loss feeding network and a high-efficiency antenna device.

BACKGROUND ART

Owing to the advantages of wide spectrum, low absorption rate and high spatial resolution, wireless applications of millimeter-wave have received extensive attention in fields including high-resolution passive imaging systems, high-precision radars, high-speed communication systems and point-to-point data transmission. High-gain antennas play a key role in millimeter-wave wireless systems. Conventional low-frequency high-gain antennas mainly include reflector antennas, horn antennas, metal waveguide antennas and micro-strip patch antennas. However, conventional reflector antenna, horn antenna and metal waveguide slot antenna have disadvantages, such as high cost, large size and low integration, which limit their commercial application. Conventional micro-strip antennas have serious insertion loss at high frequency and generate severe radiations at discontinuous structures, which lead to low efficiency, low gain and high side lobe level of the antennas.

The Substrate Integrated Waveguide (SIW) technology combines the advantages of metal waveguide and micro-strip line: low cost, low loss and easy integration. Many slot antenna arrays based on SIW technology exhibit the potential for designing high-gain antennas. However, few high-efficiency antenna devices have a gain up to 30 dBi in the W band, and corresponding conventional high-gain antennas have a problem of high insertion loss, which may affect the corresponding gain easily.

SUMMARY

In view of the above problems, the present invention provides a low-loss feeding network and a high-efficiency antenna device.

To attain the object of the present invention, the present invention provides a low-loss feeding network, which comprises a vertical switching structure, a substrate integrated waveguide, a $2^N$-way power divider, coupling slots, matching metal vias and parallel-plane waveguides.

The energy provided by a standard waveguide is coupled to the SIW through the vertical switching structure; the energy outputted by the SIW is evenly split into $2^N$ parts by the $2^N$-way power divider; and the energy of each way outputted by the $2^N$-way power divider is coupled to two parallel-plane waveguides through the coupling slots and the matching metal vias.

In an example, each of the coupling slots excites energy of two parallel-plane waveguides, which are transferred to the parallel-plane waveguides; the electric fields of two adjacent parallel-plane waveguides are equal in amplitude but opposite in phase.

In an example, the electric field at the junction of two adjacent parallel-plane waveguides is zero.

A high-efficiency antenna device, comprising: a slot antenna array, and the low-loss feeding network according to any one of the above examples, wherein the electric fields of the parallel-plane waveguides in the low-loss feeding network are equal in amplitude but opposite in phase; the energy of the electric fields that are equal in amplitude but opposite in phase in the parallel-plane waveguides is radiated in phase through the slot antenna array.

In an example, the slot antenna array is a symmetrical slot antenna array.

In an example, the low-loss feeding network is arranged at the lower layer of the slot antenna array.

In the low-loss feeding network and the high-efficiency antenna device described above, the excitation provided by a standard waveguide is coupled to the SIW through the vertical switching structure, and the energy outputted by the SIW is evenly split into $2^N$ parts ($2^N$ ways) by the $2^N$-way power divider; the energy of each way outputted by the $2^N$-way power divider is coupled to parallel-plane waveguides through the coupling slots and the matching metal vias, and the electric field at the junction of two adjacent parallel-plane waveguides is zero, so that an ideal virtual electric wall is formed, the structure of the feeding network is simplified, the metal loss at the junction is reduced, and the gain of the corresponding antenna device can be maintained; finally, the energy provided by the low-loss feeding network is radiated in phase through the symmetrical slot antenna array.

EMBODIMENTS

To make the objects, technical scheme and advantages of the present application clearer, hereunder the present application will be further described in detail with reference to the accompanying drawings and examples. It should be understood that the examples described hereunder are only provided to explain the present application but not to constitute any limitation to the present application.

The reference to "example" herein means that particular features, structures or characteristics described in connection with the example may be included in at least one example of the present application. The occurrence of that phrase in various places in the specification does not necessarily refer to the same example, nor to an independent or alternative example mutually exclusive with other examples. The person skilled in the art should understand explicitly and implicitly that the examples described herein may be combined with other examples.

Figure 1:
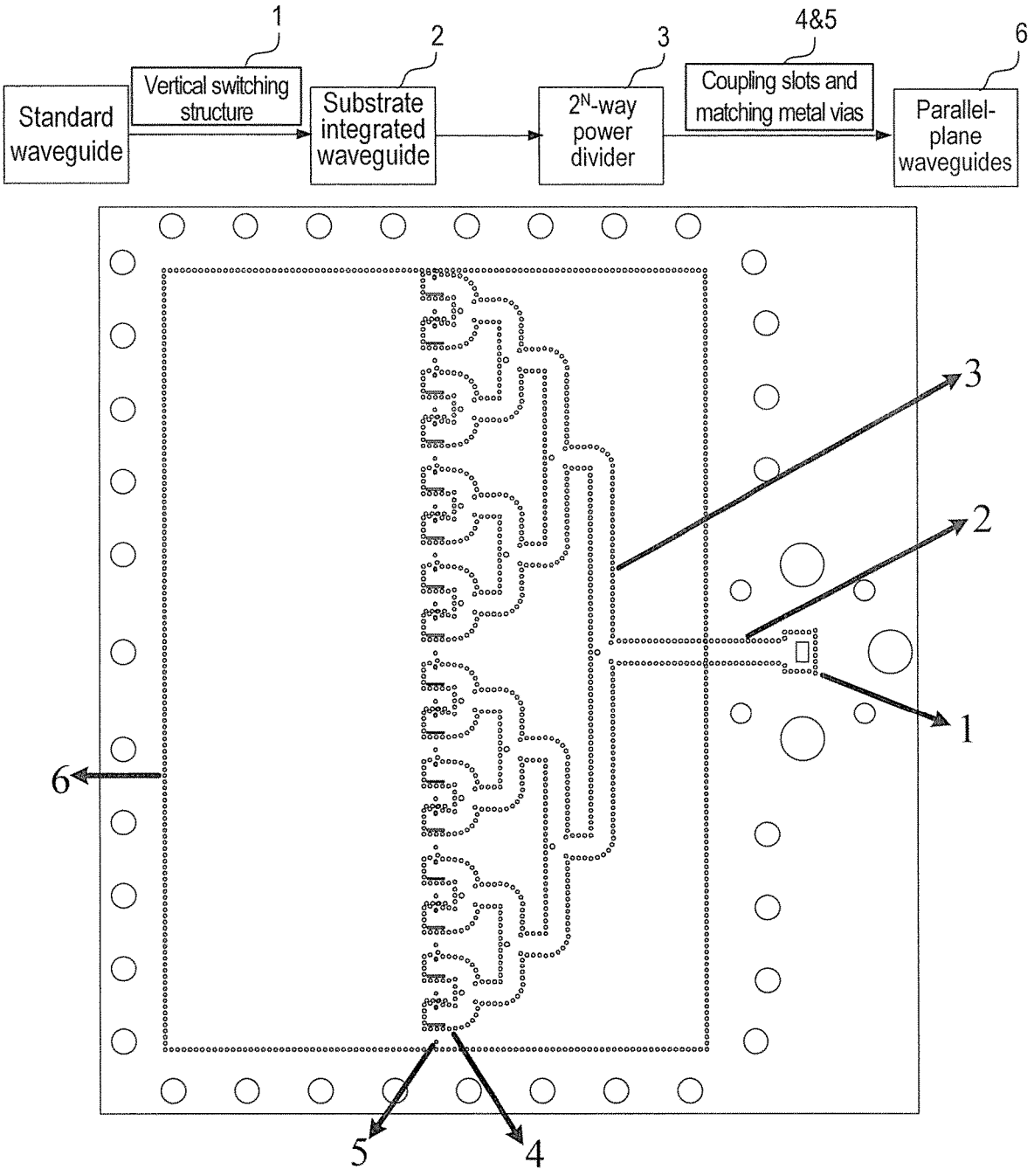
FIG. 1 is a schematic structural view of the low-loss feeding network according to an example.

Please see FIG. 1, which is a schematic structural view of the low-loss feeding network according to an example. FIG. 1 shows the structural block diagram of the low-loss feeding network as well as the positional relationship of various parts in the low-loss feeding network. As shown in FIG. 1, the low-loss feeding network comprises: a vertical switching structure 1, a substrate integrated waveguide (SIW) 2, a $2^N$-way power divider 3, coupling slots 4, matching metal vias 5 and parallel-plane waveguides 6, wherein the energy provided by a standard waveguide is coupled to the SIW 2 through the vertical switching structure 1; the energy outputted by the SIW 2 is evenly split into $2^N$ parts ($2^N$ ways) by the $2^N$-way power divider 3; and the energy of each way outputted by the $2^N$-way power divider is coupled to parallel-plane waveguides 6 through the coupling slots 4 and the matching metal vias 5.

Specifically, the energy provided by a standard waveguide is coupled to the SIW 2 through the vertical switching structure 1 (WG-to-SIW), and then the energy is evenly split into $2^N$ parts by the $2^N$-way power divider 3. The energy of each way outputted by the $2^N$-way power divider is coupled to parallel-plane waveguides 6 at the upper layer through the coupling slot 4 and the matching metal vias 5, forming the excitation that are equal in amplitude but opposite in phase, which excite two parallel-plane waveguides; moreover, the electric field at the junction of the two adjacent parallel-plane waveguides is zero, thus an ideal virtual electric wall is formed, so that the metal wall can be omitted here, thus the structure of the feeding network is simplified and the metal loss here is reduced. Finally, the energy inputted by the low-loss feeding network can be radiated via the slot antenna array at the upper layer. Furthermore, the slot antenna array at the upper layer may also adopt the excitation that are equal in amplitude and opposite in phase through central excitation, and the slot antenna array is symmetrically designed with respect to the virtual electric wall, thus ensuring the in-phase radiation of the slot antenna array.

In the low-loss feeding network described above, the excitation provided by a standard waveguide is coupled to the SIW 2 through the vertical switching structure 1, and the energy outputted by the SIW 2 is evenly split into $2^N$ parts ($2^N$ ways) by the $2^N$-way power divider 3; of the energy of each way outputted by the $2^N$-way power divider 3 is coupled to two parallel-plane waveguides 6 through the coupling slots 4 and the matching metal vias 5, and the electric field at the junction of two adjacent parallel-plane waveguides 6 is zero, so that an ideal virtual electric wall is formed, the structure of the feeding network is simplified, and the metal loss at the junction is reduced; finally, the energy provided by the low-loss feeding network is radiated in phase through the symmetrical slot antenna array.

In an example, each of the coupling slots excites energy of two parallel-plane waveguides, which are transferred to the parallel-plane waveguides; the electric fields of parallel-plane waveguides are equal in amplitude but opposite in phase.

In an example, the electric field at the junction of parallel-plane waveguides is zero.

In an example, a high-efficiency antenna device is provided, comprising: a slot antenna array, and the low-loss feeding network according to any one of the above examples, wherein the electric fields of the parallel-plane waveguides in the low-loss feeding network are equal in amplitude but opposite in phase; the energy of the electric fields that are equal in amplitude but opposite in phase in the parallel-plane waveguides is radiated in phase through the slot antenna array.

Specifically, the electric fields of the parallel-plane waveguides in the low-loss feeding network are equal in amplitude but opposite in phase, and the electric field at the junction of adjacent parallel-plane waveguides is zero, and equivalent to an virtual electric wall; the slot antenna array is symmetrically designed with respect to the virtual electric wall, which ensures that the slot antenna array can be excited in phase.

In an example, the slot antenna array is a symmetrical slot antenna array.

In an example, the low-loss feeding network is arranged at the lower layer of the slot antenna array.

In the low-loss feeding network, the excitation provided by the standard waveguide couples energy to the SIW through the vertical switching structure (WG-to-SIW), and then the energy is evenly split into $2^N$ parts by the $2^N$-way power divider. Each way of power divider couples the energy to the parallel-plane waveguides at the upper layer through the coupling slots and the matching metal vias, forming excitation of two ways equal in amplitude but opposite in phase, which excite two parallel-plane waveguides. The matching metal vias are configured to ensure good matching between coupling slots and parallel-plane waveguides. Since the parallel-plane waveguides adopt the excitation equal in amplitude but opposite in phase, the electric field at the junction of two adjacent parallel-plane waveguides is zero, thus an ideal virtual electric wall is formed here, so that the metal wall can be omitted here, thus the structure of the feeding network is simplified and the metal loss here is reduced. Finally, the low-loss feeding network can excite $2^{N+1}$ parallel-plane waveguides, and ensures that the energy is radiated in phase through the slot antenna array. Since the slot antenna array adopts the excitation equal in amplitude but opposite in phase through central excitation, the slot antenna array is symmetrically designed with respect to the virtual electric wall, thus ensuring the in-phase radiation of the slot antenna array.

Furthermore, the low-loss feeding network is disposed at the lower layer, while the symmetric slot antenna array is disposed at the upper layer. For example, the coupling slots are disposed in the upper metal layer of the $2^N$-way power divider and the lower metal layer of the parallel-plane waveguides, the matching metal vias are disposed in the dielectric layer of the parallel-plane waveguides, and the slot antenna array is located in the upper metal layer of the parallel-plane waveguides.

The high-efficiency antenna device described above has the following beneficial effects:

The entire high-efficiency antenna device includes metallized vias and metal layers, and the entire structure can be formed through traditional LTCC or PCB process; the antenna employs excitation equal in amplitude and opposite in phase, there is no conventional metallized through-hole between adjacent parallel-plane waveguides, and multiple ways of the slot antenna arrays can be excited at the same time; the slot antenna array is symmetrically designed, with high gain and efficiency at high frequency, symmetrical pattern, and low cross polarization.

Figure 2:
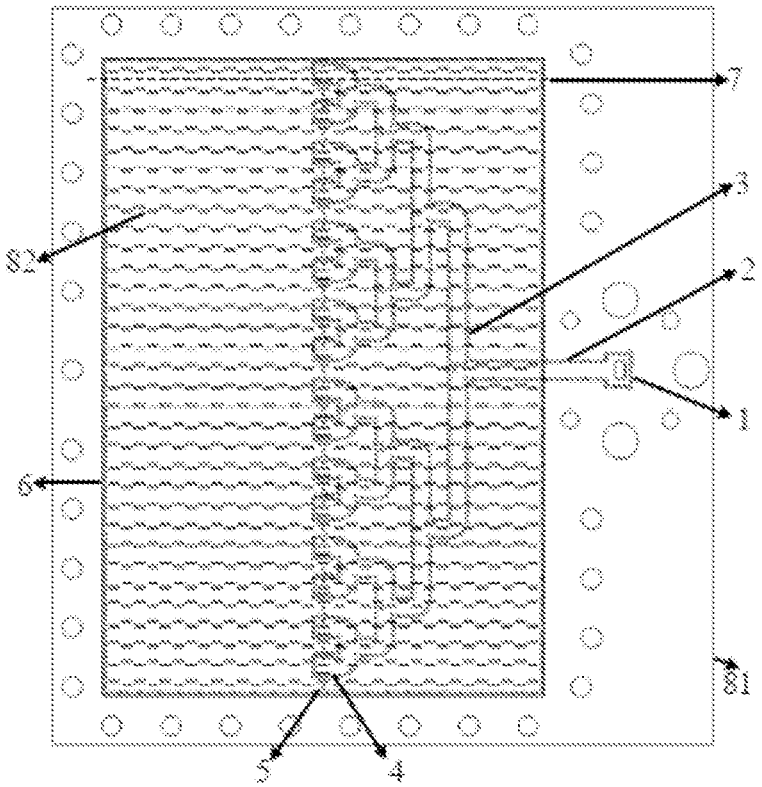
FIG. 2 is a schematic structural view of the high-efficiency antenna device according to an example.

In an example, as shown in FIG. 2, the above-mentioned high-efficiency antenna device comprises a low-loss feeding network 81 and a symmetrical slot antenna array 82. FIG. 2 further shows an virtual electric wall 7, a vertical switching structure (WG-to-SIW) 1, a substrate integrated waveguide (SIW) 2, a $2^N$-way power divider 3, coupling slots 4, matching metal vias 5 and the parallel-plane waveguides 6.

Figure 3:
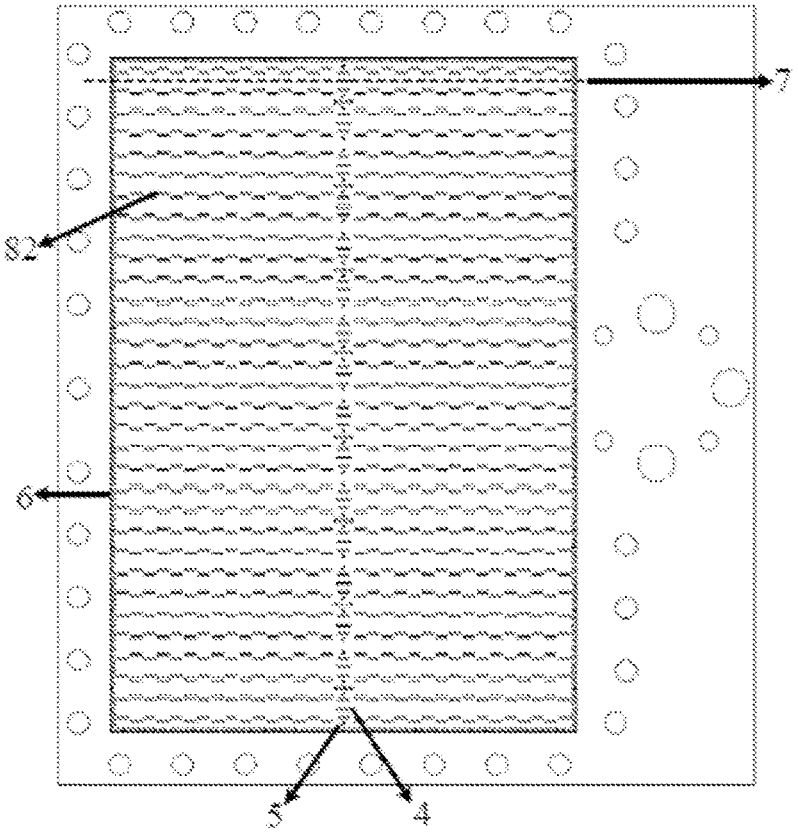
FIG. 3 is a schematic structural view of the slot antenna array of the high-efficiency antenna device according to an example.

As shown in FIG. 1, the low-loss feeding network 81 comprises a vertical switching structure (WG-to-SIW) 1, a substrate integrated waveguide (SIW) 2, a $2^N$-way power divider 3 formed by cascading N (N=1, 2, 3, . . . ) two-way power dividers, coupling slots 4, matching metal vias 5 and parallel-plane waveguides 6. The excitation provided by a standard waveguide couples energy to the SIW through the vertical switching structure, and then the energy is evenly split into $2^N$ parts by the $2^N$-way power divider 3. Each way of power divider couples the energy to the parallel-plane waveguides 6 at the upper layer through the coupling slots 4 and the matching metal vias 5, forming excitation of two ways equal in amplitude but opposite in phase, which excite two parallel-plane waveguides. The matching metal vias 5 are configured to ensure good matching between coupling slots 4 and parallel-plane waveguides 6. Since the parallel-plane waveguides adopt the excitation equal in amplitude but opposite in phase, the electric field at the junction of two adjacent parallel-plane waveguides is zero, thus an ideal virtual electric wall 7 is formed here, so that the metal wall there can be omitted, thus the structure of the feeding network is simplified and the metal loss here is reduced. Finally, the low-loss feeding network can excite $2^{N+1}$ parallel-plane waveguides, and ensures that the energy is radiated in phase through the slot antenna array. As shown in FIG. 3, since the slot antenna array 82 adopts the excitation equal in amplitude but opposite in phase through central excitation, the slot antenna array 82 is symmetrically designed with respect to the ideal virtual electric wall 7, thus ensuring the in-phase radiation of the slot antenna array.

In an example, as shown in FIGS. 1, 2 and 3, the high-efficiency antenna device comprises a low-loss feeding network 81 and a symmetric slot antenna array 82 which are arranged from bottom to top sequentially. The low-loss feeding network 81 arranged below comprises a vertical switching structure (WG-to-SIW) 1, a substrate integrated waveguide (SIW) 2, a $2^N$-way power divider 3, coupling slots 4, matching metal vias 5 and parallel-plane waveguides 6. The coupling slots 4 are disposed in the upper metal layer of the $2^N$-way power divider 3 and the lower metal layer of the parallel-plane waveguides 6. The matching metal vias 5 are disposed in the dielectric layer of the parallel-plane waveguides 6, and the slot antenna array 82 is disposed in the upper metal layer of the parallel-plane waveguides 6 and is designed symmetrically, thus ensuring the in-phase radiation of the antenna and the symmetry of the pattern.

Figure 4:
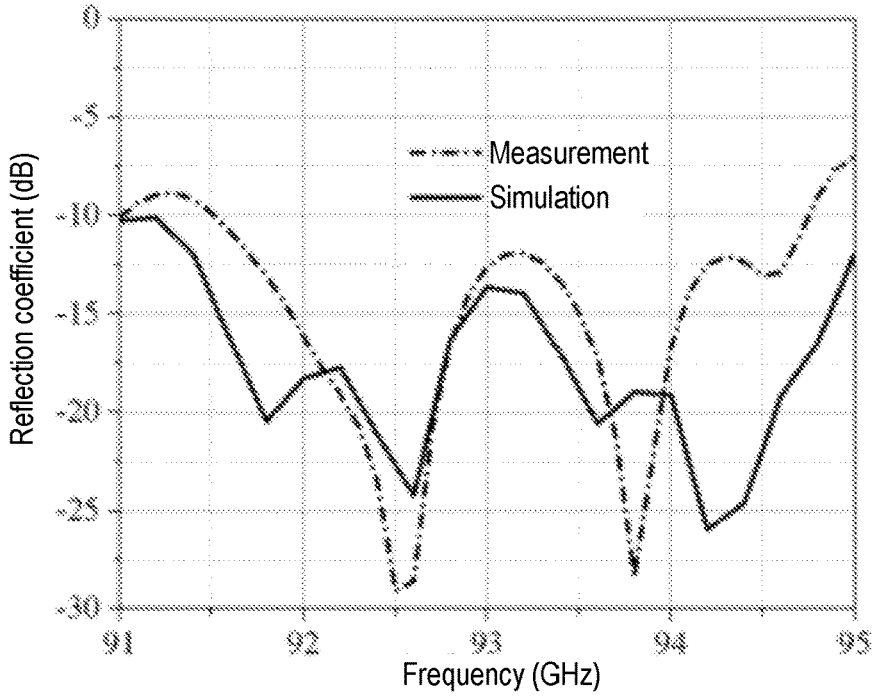
FIG. 4 shows the return loss obtained in antenna simulation and measurement according to an example.
Figure 5:
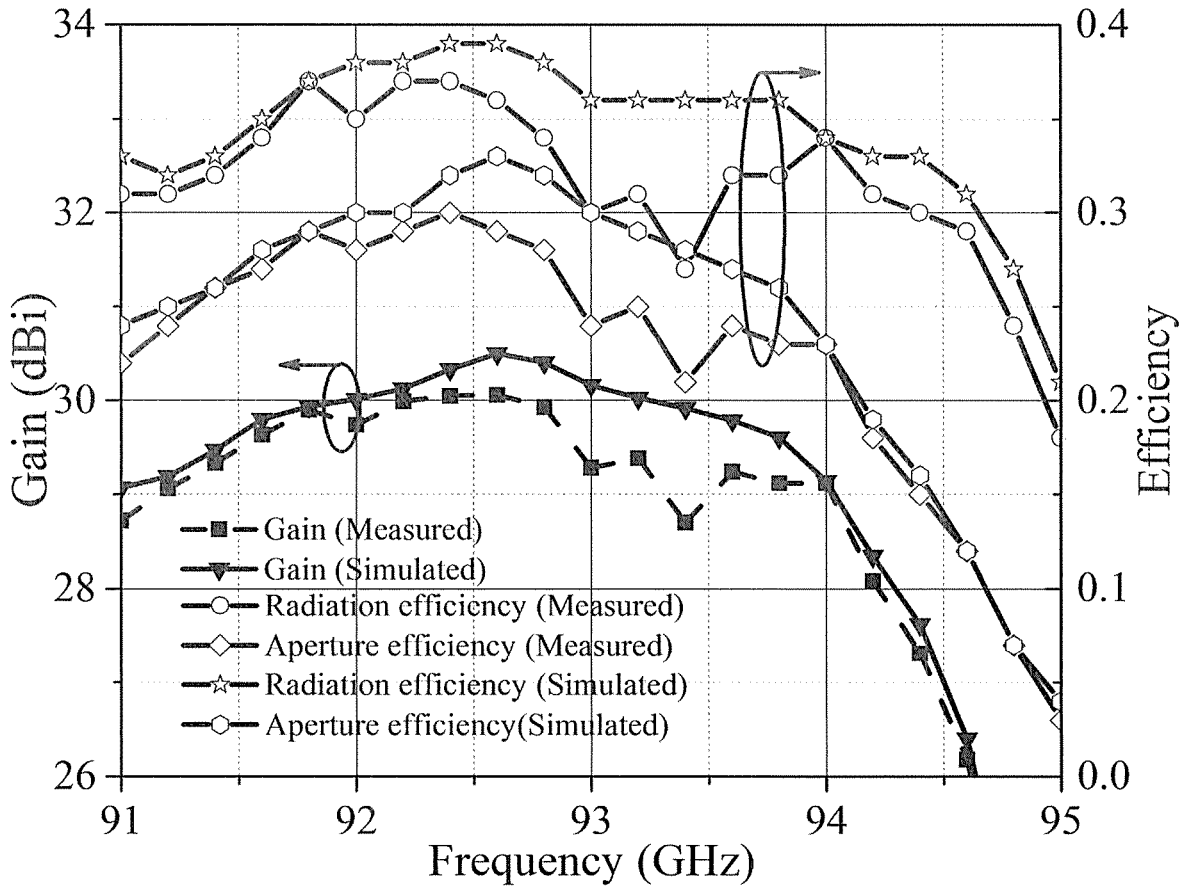
FIG. 5 is a schematic view of gain, radiation and aperture efficiencies obtained in antenna simulation and measurement according to an example.
Figure 6:
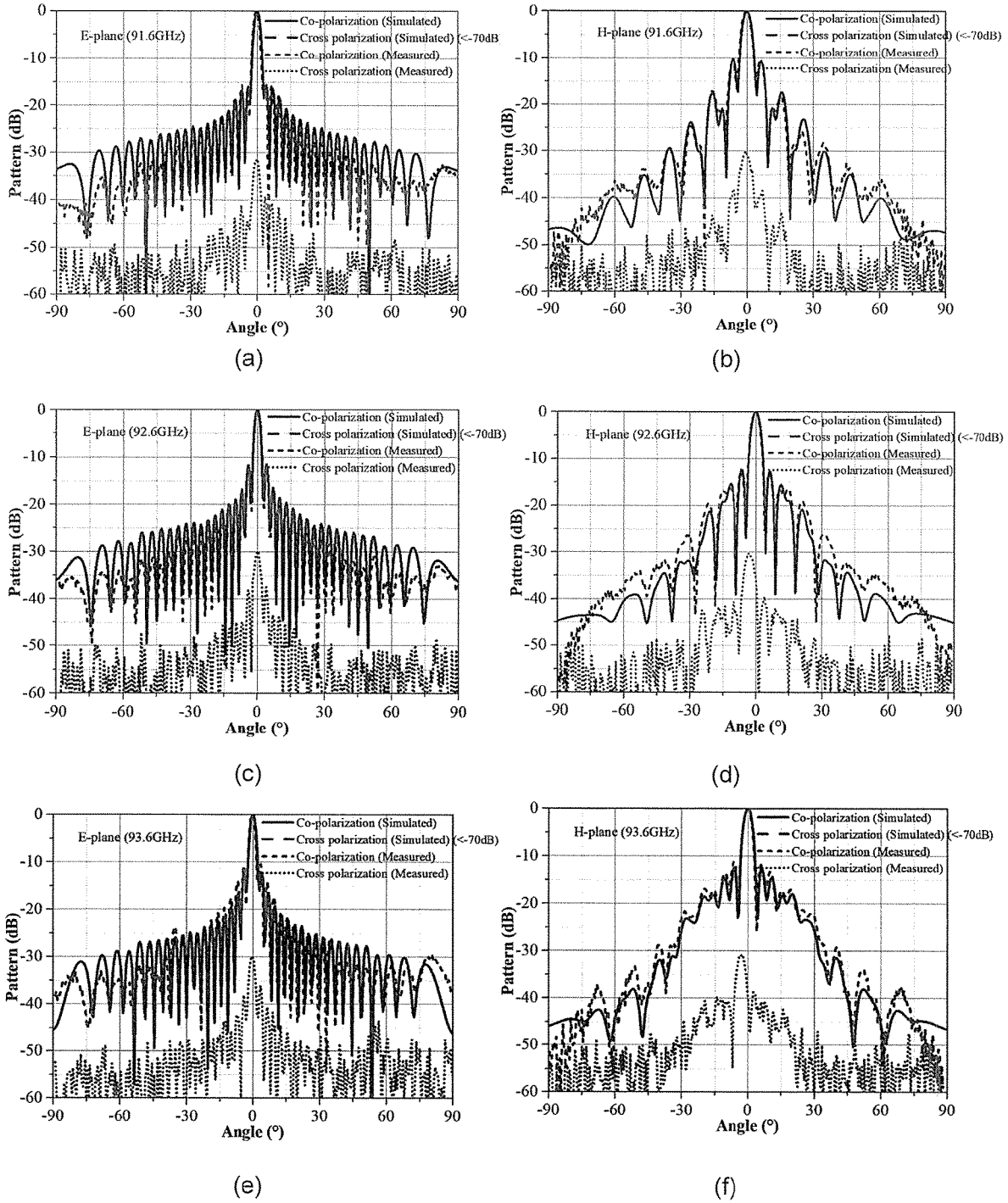
FIG. 6 shows the radiation pattern obtained in antenna simulation and measurement according to an example.

Furthermore, in this example, the high-efficiency and high-gain antenna is produced through the PCB process, and relevant tests are carried out: FIG. 4 shows the return loss obtained in the antenna simulation and measurement; FIG. 5 shows the gain, radiation and aperture efficiencies obtained in the antenna simulation and measurement; FIG. 6 shows normalized patterns of the high-gain antenna in E-plane and H-plane at 91.6 GHz, 92.6 GHz and 93.6 GHz in the simulation and measurement; the measurement results demonstrate that the high-efficiency antenna device has high radiation efficiency and high gain. Moreover, the antenna in such a structure can be applied in a high frequency band, even in a terahertz frequency band, and has high gain and high radiation efficiency at the same time. The test results demonstrate that the SIW technology combines the advantages of metal waveguide and micro-strip line: low cost, low loss and easy integration. The antenna employs a low-loss feeding network with excitation that are equal in amplitude but opposite in phase, the metal wall in the conventional SIW can be omitted, thus the feeding network structure is simplified, the insertion loss is reduced, and the gain and efficiency of the high-frequency millimeter-wave antenna are ensured.

The technical features of the above examples may be combined freely. In order to make the description concise, not all possible combinations of the technical features in the above examples are described. However, all such combinations of these technical features should be deemed as falling in the scope defined by the specification, as long as there is no contradiction among the combinations of technical features.

The terms "comprising" and "having" and all variations thereof in the examples of the present application intends to cover non-exclusive inclusion. For example, a process, method, device, product or apparatus including a series of steps or modules is not limited to the listed steps or modules, but optionally further includes steps or modules that are not listed, or optionally further includes other steps or modules inherent to the process, method, product or apparatus.

The above examples only express several embodiments of the present application, and the description is relatively specific in detailed, but they should not be understood as constituting any limitation to the scope of the present invention. It should be pointed out that for the person skilled in the art, various modifications and improvements can be made without departing from the concept of the present application, and all such modifications and improvements shall be deemed as falling in the scope of protection of the present application. Therefore, the scope of protection of the patent application is only defined by the appended claims.

What is claimed is:

1. A low-loss feeding network, comprising: a vertical switching structure, a substrate integrated waveguide, a $2^N$-way power divider, coupling slots, matching metal vias and parallel-plane waveguides;

the energy provided by a standard waveguide is coupled to the substrate integrated waveguide through the vertical switching structure; the energy outputted by the substrate integrated waveguide is evenly split into $2^N$ parts by the $2^N$-way power divider; and the energy of each way outputted by the $2^N$-way power divider is coupled to two parallel-plane waveguides through the coupling slots and the matching metal vias.

2. The low-loss feeding network according to claim 1, wherein each of the coupling slots excites energy of two parallel-plane waveguides, the excited energy of two parallel-plane waveguides is transferred to the parallel-plane waveguides; the electric fields of two adjacent parallel-plane waveguides are equal in amplitude but opposite in phase.

3. A high-efficiency antenna device, comprising: a slot antenna array, and the low-loss feeding network according to claim 2, wherein the electric fields of the parallel-plane waveguides in the low-loss feeding network are equal in amplitude but opposite in phase; the energy of the electric fields that are equal in amplitude but opposite in phase in the parallel-plane waveguides is radiated in phase through the slot antenna array.

4. The high-efficiency antenna device according to claim 3, wherein the slot antenna array is a symmetrical slot antenna array.

5. The high-efficiency antenna device according to claim 3, wherein the low-loss feeding network is arranged at the lower layer of the slot antenna array.

6. The low-loss feeding network according to claim 1, wherein the electric field at the junction of two adjacent parallel-plane waveguides is zero.

7. A high-efficiency antenna device, comprising: a slot antenna array, and the low-loss feeding network according to claim 6, wherein the electric fields of the parallel-plane waveguides in the low-loss feeding network are equal in amplitude but opposite in phase; the energy of the electric fields that are equal in amplitude but opposite in phase in the parallel-plane waveguides is radiated in phase through the slot antenna array.

8. The high-efficiency antenna device according to claim 7, wherein the slot antenna array is a symmetrical slot antenna array.

9. The high-efficiency antenna device according to claim 7, wherein the low-loss feeding network is arranged at the lower layer of the slot antenna array.

10. A high-efficiency antenna device, comprising: a slot antenna array, and the low-loss feeding network according to claim 1, wherein the electric fields of the parallel-plane waveguides in the low-loss feeding network are equal in amplitude but opposite in phase; the energy of the electric fields that are equal in amplitude but opposite in phase in the parallel-plane waveguides is radiated in phase through the slot antenna array.

11. The high-efficiency antenna device according to claim 10, wherein the slot antenna array is a symmetrical slot antenna array.

12. The high-efficiency antenna device according to claim 10, wherein the low-loss feeding network is arranged at the lower layer of the slot antenna array.

* * * * *